US008292499B2

(12) United States Patent
Nakagaki et al.

(10) Patent No.: US 8,292,499 B2
(45) Date of Patent: Oct. 23, 2012

(54) ENGINE COOLANT AMOUNT DETERMINING APPARATUS

(75) Inventors: Kazuya Nakagaki, Toyota (JP); Masanori Shibata, Toyota (JP); Masaho Narita, Okazaki (JP); Hisao Nonoyama, Kariya (JP); Nobutaka Takeuchi, Miyoshi (JP); Yukari Araki, Chiryu (JP); Hiroshi Kobae, Kariya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/937,822

(22) PCT Filed: Sep. 4, 2009

(86) PCT No.: PCT/IB2009/006748

§ 371 (c)(1),
(2), (4) Date: Oct. 14, 2010

(87) PCT Pub. No.: WO2010/032100

PCT Pub. Date: Mar. 25, 2010

(65) Prior Publication Data

US 2011/0038393 A1 Feb. 17, 2011

(30) Foreign Application Priority Data

Sep. 17, 2008 (JP) ..... 2008-238566

(51) Int. Cl.
*G01N 25/00* (2006.01)

(52) U.S. Cl. ..... 374/54; 123/41.12; 73/114.68

(58) Field of Classification Search ..... 374/54; 123/41.12; 73/114.68
See application file for complete search history.

(56) References Cited

U.S. PATENT DOCUMENTS

| | | | | |
|---|---|---|---|---|
| 3,763,836 | A | 10/1973 | Guehr | |
| 4,067,381 | A | 1/1978 | Lord | |
| 5,355,846 | A | 10/1994 | Ozawa | |
| 5,656,771 | A | 8/1997 | Beswick et al. | |
| 6,279,390 | B1 | 8/2001 | Oka et al. | |
| 6,520,136 | B2 * | 2/2003 | Ito et al. | 123/142.5 R |

FOREIGN PATENT DOCUMENTS

| | | | |
|---|---|---|---|
| DE | 197 55 859 | A1 | 6/1998 |
| DE | 198 42 167 | A1 | 3/2000 |
| FR | 2 245 854 | A1 | 4/1975 |
| JP | A-61-083430 | | 4/1986 |
| JP | A-62-291419 | | 12/1987 |
| JP | A-2005-076483 | | 3/2005 |
| JP | A-2006-142854 | | 6/2006 |

OTHER PUBLICATIONS

Japanese Office Action in Japanese Patent Application No. 2008-238566; dated Jun. 15, 2010 (with English-language translation).

(Continued)

*Primary Examiner* — Lisa Caputo
*Assistant Examiner* — Jamel Williams
(74) *Attorney, Agent, or Firm* — Oliff & Berridge, PLC

(57) ABSTRACT

An engine coolant amount determining apparatus includes an electric water pump that can be operated intermittently while an engine is running, and a coolant temperature detecting means for detecting the temperature of coolant at a location higher than the water pump. The engine coolant amount determining apparatus also includes determining means for determining that the amount of coolant is equal to or less than a predetermined amount when the degree of change in the coolant temperature detected by the coolant temperature detecting means when the water pump is operated intermittently is large.

10 Claims, 3 Drawing Sheets

U.S. PATENT DOCUMENTS

| | | | | |
|---|---|---|---|---|
| 7,216,697 | B2 * | 5/2007 | Odeskog et al. | 165/202 |
| 7,467,605 | B2 * | 12/2008 | Szalony et al. | 123/41.04 |
| 2004/0035194 | A1 | 2/2004 | Wakahara | |
| 2004/0083744 | A1 * | 5/2004 | Harte | 62/130 |
| 2006/0196634 | A1 * | 9/2006 | Sato et al. | 165/41 |
| 2010/0242452 | A1 * | 9/2010 | Kawazu et al. | 60/299 |
| 2011/0111920 | A1 * | 5/2011 | Gooden et al. | 477/98 |
| 2011/0126783 | A1 * | 6/2011 | Hwang et al. | 123/41.1 |

OTHER PUBLICATIONS

Written Opinion of International Searching Authority in International Application No. PCT/IB2009/006748; dated Feb. 15, 2010.
International Search Report in International Application No. PCT/IB2009/006748; dated Feb. 15, 2010.
Jun. 19, 2012 Office Action issued in German Patent Application No. 11 2009 002 059.3 (with translation).

* cited by examiner

ENGINE COOLANT AMOUNT DETERMINING APPARATUS

BACKGROUND OF THE INVENTION

1. Field of the Invention

The invention relates to a coolant amount determining apparatus which determines the amount of engine coolant.

2. Description of the Related Art

Japanese Patent Application Publication No. 2005-76483 (JP-A-2005-76483), for example, describes a cooling system which cools an engine by supplying coolant to the engine using a mechanical water pump driven by the engine.

The amount of coolant supplied for cooling the engine can be checked by checking the amount of coolant stored in a reservoir tank that is arranged in the coolant circulation path. However, because the reservoir tank is housed in the engine compartment or the like, it is necessary to open the engine compartment when checking the coolant amount, which makes checking the coolant amount extremely bothersome.

On the other hand, when there is an insufficient amount of coolant, an excessive rise in the coolant temperature can be determined by a temperature gauge that monitors the coolant temperature detected by known coolant temperature detecting means. However, the accuracy with a temperature gauge that simply monitors the temperature of the coolant detected by the coolant temperature detecting means is low. Moreover, the mechanical water pump is normally driven when the engine is running, so coolant that is discharged from this water pump is constantly in contact with the sensor portion of the coolant temperature detecting means. As a result, the degree of change in the coolant temperature detected by the coolant temperature detecting means is flat with little fluctuation. Therefore, with a temperature gauge that has low accuracy and which simply monitors the temperature of coolant that is detected by the coolant temperature detecting means, it. is difficult to recognize an excessive rise in the coolant temperature. Therefore, even if it becomes clear that the coolant amount is insufficient when an excessive rise in coolant temperature is recognized, the engine may already be overheating so it is not possible to prevent the engine from overheating.

SUMMARY OF THE INVENTION

The invention provides an engine coolant amount determining apparatus capable of preventing an engine from overheating without requiring that the engine compartment be opened and the coolant amount checked.

A first aspect of the invention relates to an engine coolant amount determining apparatus. This determining apparatus includes a water pump capable of being operated intermittently while an engine is running, coolant temperature detecting means for detecting the temperature of coolant at a location higher than the water pump, and determining means for determining whether the amount of coolant is equal to or less than a predetermined amount based on a degree of change in the temperature that is detected by the coolant temperature detecting means when the water pump is operated intermittently.

According to this structure, it is determined whether the amount of coolant is equal to or less than predetermined amount based on the degree of change in the temperature detected by the coolant temperature detecting means when the water pump is operated intermittently. For example, when the degree of change in the detected temperature is large, it is determined that the amount of coolant is equal to or less than the predetermined amount, so the extremely bothersome work of opening the engine compartment and checking the amount of coolant in the reservoir tank when checking the coolant amount is not longer necessary. Moreover, it is made known that the amount of coolant is equal to or less than the predetermined amount before the driver even notices that the coolant temperature has risen too high by a temperature gauge that monitors the temperature of the coolant temperature detected by the coolant temperature sensor. As a result, the engine can be prevented from overheating. In addition, the determination as to whether the amount of coolant is equal to or less than the predetermined amount can be made using a known coolant temperature sensor while the water pump is operated intermittently. As a result, there is no need to add new detecting means, which also helps to keep costs down.

In the structure described above, the degree of change in the temperature may be a difference between the detected temperature when the water pump is operated and the detected temperature when the water pump is stopped, during intermittent operation of the water pump.

In the structure described above, the determining means may determine that the amount, of coolant is equal to or less than the predetermined amount when the degree of change in the temperature detected by the coolant temperature detecting means is large.

In the structure described above, the determining means may determine that the amount of coolant is equal to or less than the predetermined amount when the change in the temperature detected by the coolant temperature detecting means is equal to or greater than a predetermined amount of change In the structure described above, the determining means may determine whether the amount of coolant is equal to or less than the predetermined amount after the engine has finished warming up.

According to this structure, the difference in the temperature between the air and the coolant in the coolant circulation path is greater after the engine has finished warming up than it is right after the engine has just started to warm up. Therefore, it is possible to clearly distinguish whether air or coolant is contacting the sensor portion of the coolant temperature detecting means, so the determination by the determining means as to whether the amount of coolant is equal to or less than the predetermined amount can be made even more accurately.

In the structure described above, the water pump may be operated intermittently after the engine has finished warming up.

In the structure described above, the water pump may be operated intermittently for a predetermined period of time.

In the structure described above, the engine coolant amount determining apparatus may also include indicating means for indicating that the amount of coolant is equal to or less than the predetermined amount when it has been determined by the determining means that the amount of coolant is equal to or less than the predetermined amount.

This structure makes it possible to reliably notify the driver, via the indicating means, that the amount of coolant is equal to or less than the predetermined. amount.

In the structure described above, the coolant temperature detecting means may be arranged between the engine and a radiator that cools the coolant.

In the structure described above, the intervals at which the temperature is detected by the coolant temperature detecting means may be smaller than the intervals at which the water pump is operated intermittently.

The structure described above makes it possible to determine whether the amount of coolant is equal to or less than a predetermined amount based on the degree of change in the temperature detected by the coolant temperature detecting means when the water pump is operated intermittently. For example, by determining that the amount of coolant is equal to or less than the predetermined amount when the degree of change in the detected temperature is large, the extremely bothersome work of opening the engine compartment and checking the amount of coolant in the reservoir tank when checking the coolant amount is not longer necessary. Moreover, it can be determined that the coolant amount is equal to or lower than the predetermined amount before the driver even notices that the coolant temperature has risen too high by a temperature gauge. As a result, the engine can be prevented from overheating. In addition, the determination as to whether the coolant amount is equal to or less than the predetermined amount can be made using a known coolant temperature sensor while the water pump is being operated intermittently. Therefore, there is no need to add new detecting means, which also helps to keep costs down.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF AN EMBODIMENT

An example embodiment of the present invention will be described in greater detail below with reference to the accompanying drawings.

Figure 1:
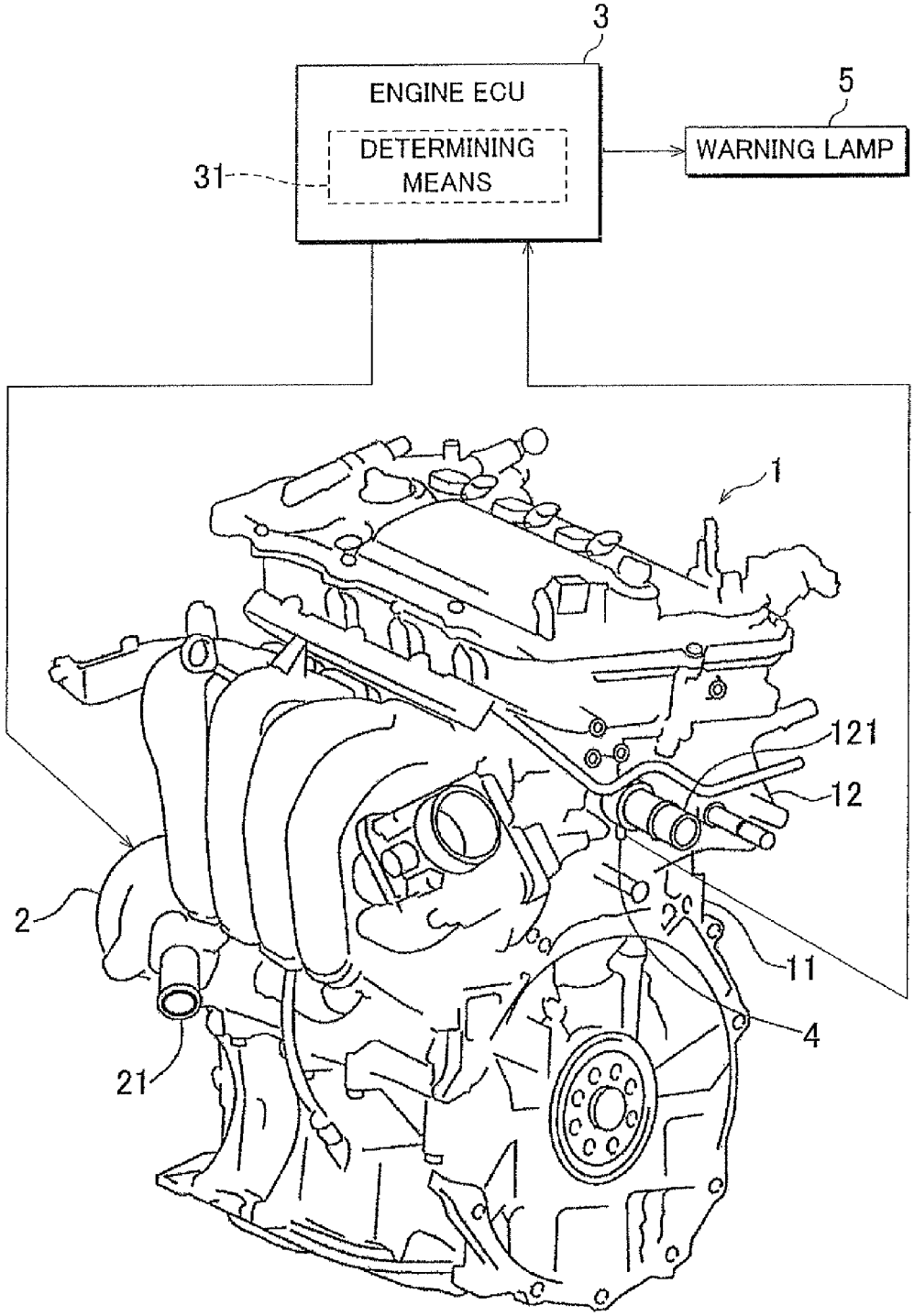
FIG. 1 shows a system block diagram of an engine coolant amount determining apparatus according to an example embodiment of the invention.

FIG. 1 shows an automobile engine (hereinafter simply referred to as "engine") 1 provided with a coolant amount determining apparatus according to an example embodiment of the invention. This engine 1 is provided with an electric water pump 2 on the front side surface of a cylinder block 11. This water pump 2 is driven using a supply of power that is independent from the operation of the engine 1, and operation of the water pump 2 is controlled by an engine ECU 3. That is, the water pump 2 is able to operate intermittently while the engine 1 is running.

Coolant that is discharged from the water pump 2 is supplied via the cylinder block 11 to a cylinder head 12 arranged on the upper surface of the cylinder block 11. The flow path of the coolant that is supplied to the cylinder head 12 can be switched between two paths depending on the temperature of the coolant. One of the paths is a coolant circulation path by which the coolant is returned an inlet 21 of the water pump 2 via a radiator, not shown, from a coolant passage, also not shown. The other path is a bypass path by which the coolant is returned to the inlet 21 of the water pump 2 via a bypass passage, not shown, that bypasses the radiator. The coolant passage is connected to a coolant delivery line 121 that protrudes out from the rear surface of the cylinder head 12.

Also, a coolant temperature sensor 4, which serves as coolant temperature detecting means for detecting the temperature of the coolant supplied to cool the cylinder head 12, is provided at the base portion of the coolant delivery line 121. This coolant temperature sensor 4 is arranged in a location that is higher than the water pump 2. A signal indicative of the temperature of the coolant that is detected by the coolant temperature sensor 4 is output to the engine ECU 3.

The engine ECU 3 has determining means 31 for determining whether the coolant has not been added to the coolant circulation path or the bypass path when changing the coolant (hereinafter simply referred to as "coolant has not been added"), or whether the amount of coolant flowing through the coolant circulation path or the bypass path is insufficient. The determining means 31 inputs the signal indicative of the temperature of the coolant detected by the coolant temperature sensor 4 as needed. A case in which coolant has not been added and a case in which the coolant amount is insufficient may correspond to the coolant being equal to or less than a predetermined amount.

Figure 2:
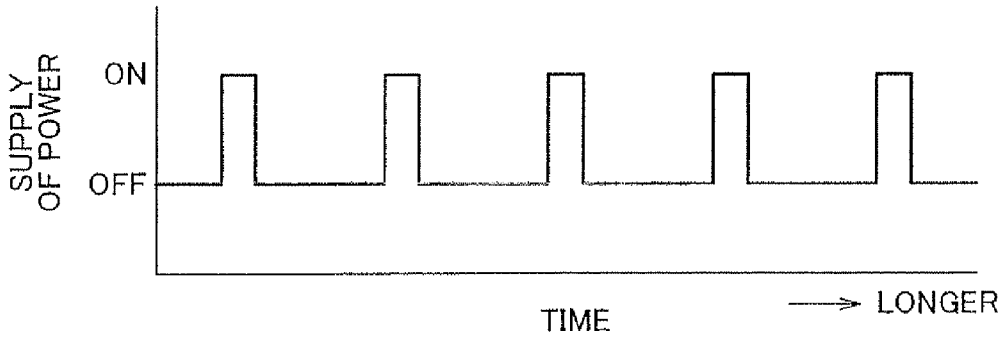
FIG. 2 shows a characteristics diagram of the characteristics of power supply with respect to time when the water pump is operated intermittently.
Figure 3:
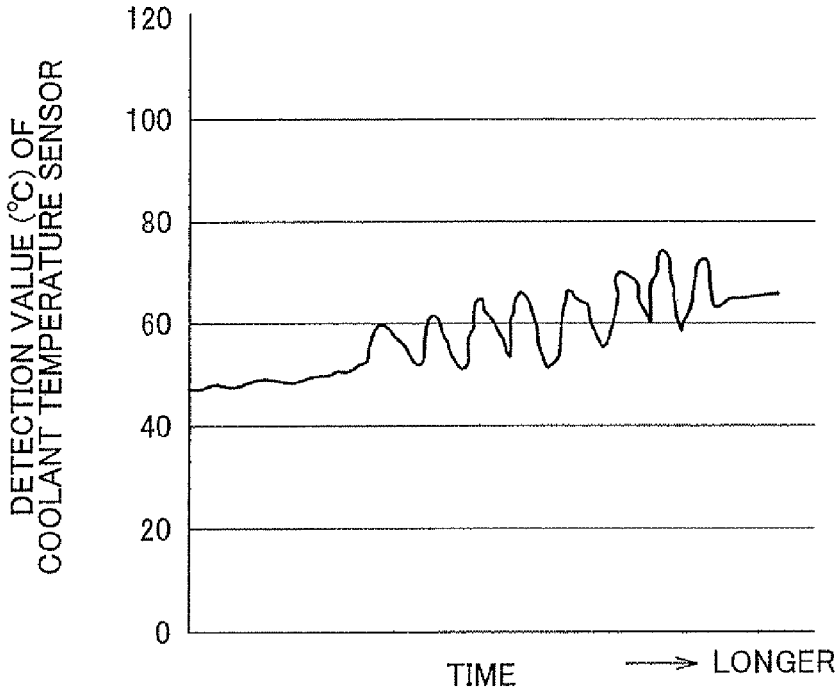
FIG. 3 shows a characteristics diagram of the characteristics of the detection value of a coolant temperature sensor with respect to time when the water pump is operated intermittently.

Then, after the engine 1 has finished warming up (e.g., when the coolant temperature exceeds 50° C.) the determining means 31 determines whether coolant has not been added or the coolant amount is insufficient based on the degree of change in the coolant temperature detected by the coolant temperature sensor 4 when the water pump 2 is operated intermittently by the engine ECU 3. More specifically, after the engine 1 has finished warming up, e.g., when the coolant temperature has reached 50° C., the water pump 2 is operated intermittently (at a frequency of five times in 10 seconds, for example) by turning the supply of power to the water pump 2 on and off, as shown in FIG. 2. If during this intermittent operation the degree of change in the coolant temperature detected by the coolant temperature sensor 4 when the water pump 2 is operated and then stopped is large, as shown in FIG. 3, the determining means 31 determines that the coolant amount is insufficient. In this case, the degree of change in the coolant temperature according to the coolant temperature sensor 4 when the water pump 2 is operated and then stopped fluctuates greatly due to the sensor portion of the coolant temperature sensor 4 contacting not only coolant, but air when the water pump 2 is stopped.

Returning now to FIG. 1, a warning lamp 5, which serves as indicating means for indicating that coolant has not been added or that the coolant amount is insufficient, is provided in a dash panel, not shown, of the automobile with the engine 1. When the determining means 31 has determined that coolant has not been added or the coolant amount is insufficient, the warning lamp 5 illuminates. A temperature gauge, not shown, for monitoring the coolant temperature detected by the coolant temperature sensor 4 is also provided on the dash panel.

Figure 4:
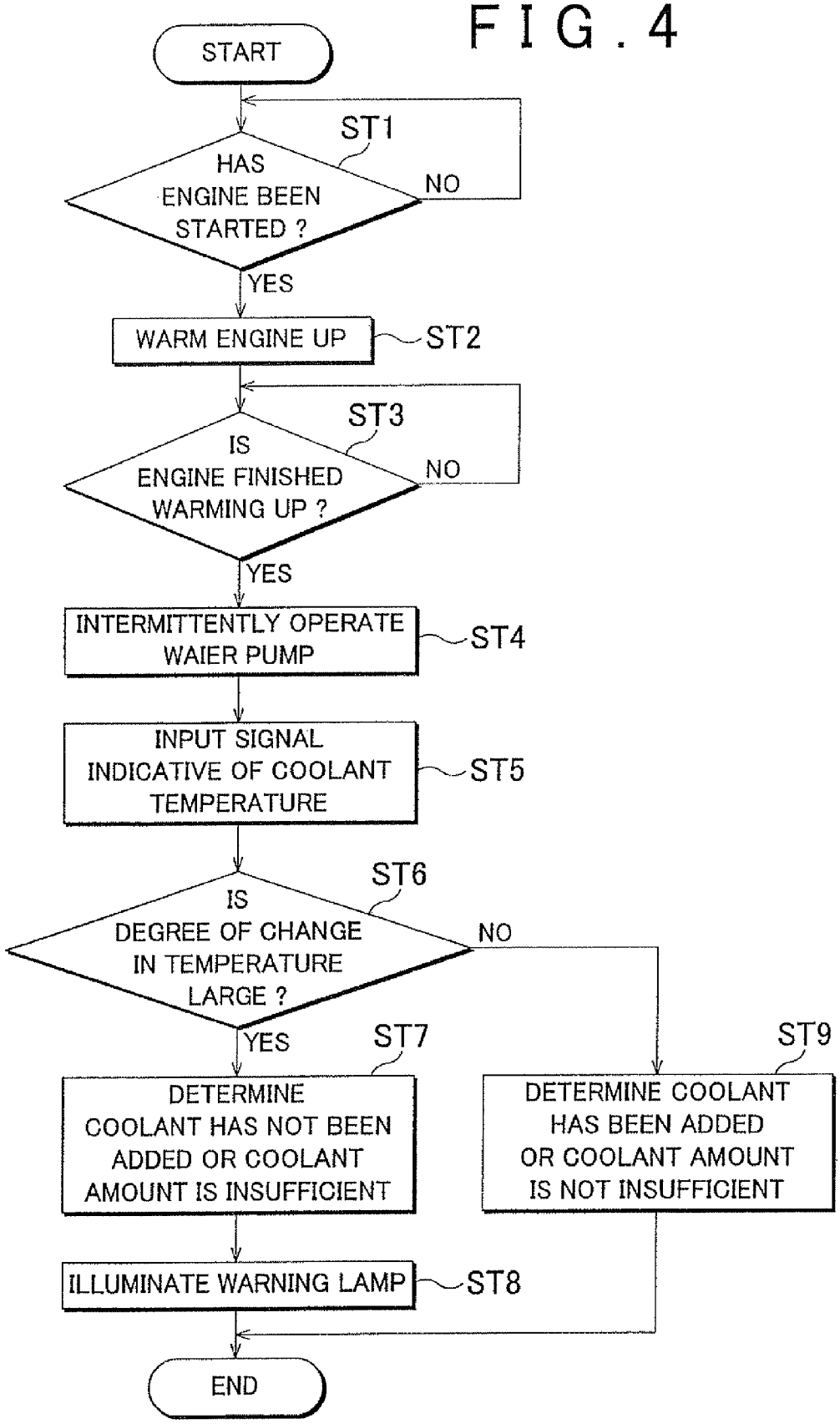
FIG. 4 shows a flowchart illustrating a control routine executed by an engine ECU when determining the coolant amount by determining means.

Next, a control routine executed by the engine ECU 3 when the determining means 31 determines the coolant amount will be described with reference to the flowchart in FIG. 4.

First in step ST1, the engine ECU 3 waits until the engine 1 has been started. After the engine 1 is started, the engine ECU 3 warms up the engine 1 in step ST2. At this time, the water pump 2 may be operated continuously or intermittently.

Then after waiting until the engine 1 has finished warming up, which is indicated by the coolant temperature reaching a warm-up complete temperature (such as 50° C.), in step ST3, the engine ECU 3 then operates the water pump intermittently (at a frequency of five times in 10 seconds, for example) in step ST4.

Next in step ST5, the engine ECU 3 receives a signal indicative of the coolant temperature from the coolant temperature sensor 4, and then in step ST6, determines the degree of change in the coolant temperature indicated by the signal received in step ST5. More specifically, the engine ECU 3 determines whether the degree of change in the coolant temperature when the water pump 2 is operated and then stopped is large (such as 10° C. or more), as shown in FIG. 3.

If the determination in step ST6 is yes, i.e., if the degree of change in the coolant temperature when the water pump 2 is operated and then stopped is large, the engine ECU 3 determines in step ST7 that coolant has not been added or the amount of coolant is insufficient. Therefore in step ST8, the engine ECU 3 illuminates the warning lamp 5 on the dash panel to notify the driver that coolant has not been added or the coolant amount is insufficient, after which the determination by the determining means 31 ends.

If, on the other hand, the determination in step ST6 is no, i.e., if the degree of change in the coolant temperature is small, the engine ECU 3 determines in step ST9 that coolant has been added or the coolant amount is not insufficient, and the determination by the determining means 31 ends. That is, if there is a sufficient amount of coolant, then the coolant temperature sensor 4 will not contact air when the water pump 2 is operated intermittently, so the degree of change in the coolant temperature will be small.

In this way, it is possible to determine whether coolant has not been added or the coolant amount is insufficient based on the degree of change in the coolant temperature when the water pump 2 is operated and then stopped, which is detected by the coolant temperature sensor 4 when the water pump 2 is operated intermittently. That is, when the degree of change in the temperature is large (such as 10° C. or more), it is determined that coolant has not been added or the coolant amount is insufficient. Therefore, when checking the coolant amount, it is no longer necessary to open the engine compartment and check the amount of coolant in the reservoir tank. Moreover, it is made known that coolant has not been added or the coolant amount is insufficient before the driver even notices that the coolant temperature has risen too high by the temperature gauge that monitors the temperature of the coolant temperature detected by the coolant temperature sensor 4. As a result, the engine 1 can be prevented from overheating.

In addition, the determination as to whether coolant has not been added or the coolant amount is insufficient is made using the known coolant temperature sensor 4 while operating the water pump 2 intermittently. As a result, there is no need to add new detecting means for detecting whether coolant has not been added or the coolant amount is insufficient, which also helps to keep costs down.

The determination as to whether coolant has not been added or the coolant amount is insufficient is made by the determining means 31 after the engine 1 has finished warming up. Therefore, because there is a large temperature difference between the air and the coolant flowing through the coolant circulation path and the bypass path after the engine 1 has finished warming up compared to immediately after the engine 1 has just started to warm up, it becomes easy to distinguish whether air or coolant is contacting the sensor portion of the coolant temperature sensor 4, so the determination by the determining means 31 as to whether coolant has not been added or the coolant amount is insufficient can be made even more accurately.

Furthermore, when the determining means 31 has determined that coolant has not been added or the coolant amount is insufficient, the warning lamp 5 on the dash panel is illuminated to notify the driver. This enables the driver to be reliably notified that coolant has not been added or the coolant amount is insufficient.

Incidentally, the invention is not limited to this example embodiment. That is, the invention also includes various modified examples of the example embodiment. For example, in the example embodiment described above, the water pump 2 is operated intermittently after the engine 1 has finished warming up. Alternatively, for example, the water pump may be operated intermittently right after the engine starts to warm up or while the engine is warming up, and the determination as to whether coolant has not been added or the coolant amount is insufficient may be made by the determining means at that time.

Also, in the example embodiment described above, the water pump is an electric water pump, but it may also be a mechanical water pump that can be operated intermittently when the engine is running. Providing such a mechanical water pump with a clutch mechanism that can interrupt the flow of driving force from the crankshaft enables the mechanical water pump to be operated intermittently, even when the engine is running, by disengaging the clutch.

While the invention has been described with reference to example embodiments thereof, it is to be understood that the invention is not limited to the described embodiments or constructions. To the contrary, the invention is intended to cover various modifications and equivalent arrangements. In addition, while the various elements of the disclosed invention are shown in various example combinations and configurations, other combinations and configurations, including more, less or only a single element, are also within the scope of the appended claims.

The invention claimed is:

1. An engine coolant amount determining apparatus comprising:

a water pump capable of being operated intermittently while an engine is running;

a coolant temperature detecting portion that detects the temperature of coolant at a location higher than the water pump; and a determining portion that determines whether the amount of coolant is equal to or less than a predetermined amount based on a degree of change in the temperature that is detected by the coolant temperature detecting portion when the water pump is operated intermittently.

2. The engine coolant amount determining apparatus according to claim 1, wherein the degree of change in the temperature is a difference between the detected temperature when the water pump is operated and the detected temperature when the water pump is stopped, during intermittent operation of the water pump.

3. The engine coolant amount determining apparatus according to claim 1, wherein the determining portion determines that the amount of coolant is equal to or less than the predetermined amount when the degree of change in the temperature detected by the coolant temperature detecting portion is large.

4. The engine coolant amount determining apparatus according to claim 1, wherein the determining portion determines that the amount of coolant is equal to or less than the predetermined amount when the change in the temperature detected by the coolant temperature detecting portion is equal to or greater than a predetermined amount of change.

5. The engine coolant amount determining apparatus according to claim 1, wherein the determining portion determines whether the amount of coolant is equal to or less than the predetermined amount after the engine has finished warming up.

6. The engine coolant amount determining apparatus according to claim 5, wherein the water pump is operated intermittently after the engine has finished warming up.

7. The engine coolant amount determining apparatus according to claim 1, wherein the water pump is operated intermittently for a predetermined period of time.

8. The engine coolant amount determining apparatus according to claim 1, further comprising:

indicating portion that indicates that the amount of coolant is equal to or less than the predetermined amount when it has been determined by the determining portion that the amount of coolant is equal to or less than the predetermined amount.

9. The engine coolant amount determining apparatus according to claim 1, wherein the coolant temperature detecting portion is arranged between the engine and a radiator that cools the coolant.

10. The engine coolant amount determining apparatus according to claim 1, wherein the intervals at which the temperature is detected by the coolant temperature detecting portion are smaller than the intervals at which the water pump is operated intermittently.

* * * * *